US006717558B1

(12) United States Patent
Weitbruch et al.

(10) Patent No.: US 6,717,558 B1
(45) Date of Patent: Apr. 6, 2004

(54) METHOD FOR PROCESSING VIDEO PICTURES FOR DISPLAY ON A DISPLAY DEVICE AND APPARATUS FOR CARRYING OUT THE METHOD

(75) Inventors: Sebastien Weitbruch, Mönchweiler (DE); Carlos Correa, Villingen-Schwenningen (DE); Rainer Zwing, Villingen-Schwenningen (DE); Didier Doyen, La Bouexière (FR)

(73) Assignee: Thomson Licensing S.A., Boulogne Cedex (FR)

( * ) Notice: Subject to any disclaimer, the term of this patent is extended or adjusted under 35 U.S.C. 154(b) by 0 days.

(21) Appl. No.: 09/551,335

(22) Filed: Apr. 18, 2000

(30) Foreign Application Priority Data

Apr. 28, 1999 (EP) ..... 99401036

(51) Int. Cl.[7] ..... G09G 3/28; G09G 5/10

(52) U.S. Cl. ..... 345/63; 345/690

(58) Field of Search ..... 345/60, 63, 68, 345/690, 691, 692, 693, 694, 589, 596, 597, 598, 599, 89; 315/169.3; 382/237

(56) References Cited

U.S. PATENT DOCUMENTS 6,008,793 A * 12/1999 Shigeta ..... 345/204
6,034,659 A * 3/2000 Wald et al. ..... 345/76
6,052,112 A * 4/2000 Tanaka et al. ..... 345/596
6,088,012 A * 7/2000 Shigeta et al. ..... 345/63
6,091,396 A * 7/2000 Minami et al. ..... 345/690
6,097,368 A * 8/2000 Zhu et al. ..... 345/63
6,100,863 A * 8/2000 Zhu ..... 345/89
6,108,122 A * 8/2000 Ulrich et al. ..... 345/691
6,201,519 B1 * 3/2001 Chevet et al. ..... 345/63
6,333,766 B1 * 12/2001 Kougami et al. ..... 345/690
6,340,961 B1 * 1/2002 Tanaka et al. ..... 345/63
6,370,275 B1 * 4/2002 Benoit et al. ..... 382/237
6,373,477 B1 * 4/2002 Van Dijk ..... 345/204
6,388,677 B1 * 5/2002 Doyen et al. ..... 345/690
6,404,440 B1 * 6/2002 Doyen et al. ..... 345/690
6,424,325 B1 * 7/2002 Van Dijk ..... 345/60
6,473,464 B1 * 10/2002 Weitbruch et al. ..... 375/240.26
6,476,875 B2 * 11/2002 Correa et al. ..... 345/691

FOREIGN PATENT DOCUMENTS

EP 0874349 10/1998 ..... G09G/3/28

OTHER PUBLICATIONS

Patent Abstracts of Japan, vol. 199, No. 711, Jul. 11, 1999 & JP 09 179523 A (Fujitsu General Ltd.), Jul. 11, 199 (Jul. 11, 1977) *abstract.
Copy of Search Report.

* cited by examiner

*Primary Examiner*—Steven Saras
*Assistant Examiner*—Paul A. Bell
(74) *Attorney, Agent, or Firm*—Joseph S. Tripoli; Harvey D. Fried; Sammy S. Henig

(57) ABSTRACT

With the new plasma display panel technology new kinds of artifacts can occur in video pictures due to the principle that brightness control is done with a modulation of small lighting pulses in a number of periods called sub-fields. These artifacts are commonly described as 'dynamic false contour effect'. A technique called bit line repeat coding has been developed for reducing the false contour effect. According to this technique sub-field coding is done with common (CSF) and normal sub-fields (SF) where for the common sub-fields (CSF) identical entries in the sub-field code words of two or more corresponding pixels on two or more pixel lines are used. In this specific sub-field coding method some cases will occur in which an error has to be made due to the reduced flexibility in encoding produced by the need to have the same code on common sub-fields (CSF). The general idea of the invention is now to put the coding failures on the higher video levels of the two or more pixels being grouped together.

Further improvements concern picture content analysis and or motion detection for controlling the switching between different sub-field coding modes and a specific adapted dithering pattern for use with bit line repeat coding.

15 Claims, 7 Drawing Sheets

| | | |
|---|---|---|
| Line n | 36 | |
| Line n+1 | 51 | |

METHOD FOR PROCESSING VIDEO PICTURES FOR DISPLAY ON A DISPLAY DEVICE AND APPARATUS FOR CARRYING OUT THE METHOD

The invention relates to a method for processing video pictures for display on a display device. More specifically the invention is closely related to a kind of video processing for improving the picture quality of pictures which are displayed on matrix displays like plasma display panels (PDP) or other display devices where the pixel values control the generation of a corresponding number of small lighting pulses on the display.

BACKGROUND OF THE INVENTION

Although plasma display panels are known for many years, plasma displays are encountering a growing interest from TV manufacturers. Indeed, this technology now makes it possible to achieve flat color panels of large size and with limited depths without any viewing angle constraints. The size of the displays may be much larger than the classical CRT picture tubes would have ever been allowed.

Referring to the latest generation of European TV sets, a lot of work has been made to improve its picture quality. Consequently, there is a strong demand, that a TV set built in a new technology like the plasma display technology has to provide a picture so good or better than the old standard TV technology. On one hand, the plasma display technology gives the possibility of nearly unlimited screen size, also of attractive thickness, but on the other hand, it generates new kinds of artifacts which could damage the picture quality. Most of these artifacts are different from the known artifacts occurring on classical CRT color picture tubes. Already due to this different appearance of the artifacts they are more visible to the viewer since the viewer is used to see the well-known old TV artifacts.

The invention deals with a specific new artefact, which is called "dynamic false contour effect" since it corresponds to disturbances of gray levels and colors in the form of an apparition of colored edges in the picture when an observation point on the matrix screen moves. This kind of artefact is enhanced when the image has a smooth gradation like when the skin of a person is being displayed (e. g. displaying of a face or an arm, etc.). In addition, the same problem occurs on static images when observers are shaking their heads and that leads to the conclusion that such a failure depends on the human visual perception and happens on the retina of the eye.

Some approaches have been discussed to compensate for the false contour effect. The false contour effect is directly related to the sub-field organization and the more sub-fields will be used, the better the result is. The term sub-field organization will be explained in greater detail below but for the moment it should be noted that it is a kind of decomposition of the 8-bit gray level in 8 or more lighting sub-periods. An optimization of such a picture encoding will have, indeed, a positive effect on the false contour effect. Nevertheless, the increasing of the sub-field number needs to allocate more time for the addressing periods (since information has to be loaded in the panel for each sub-field) and the complete time available for addressing and lighting is limited (for instance 20 ms/frame for a 50 Hz panel operating in progressive scan mode).

Another approach for the solution of above-mentioned problem is known under the expression "pulse equalization technique". This technique is a more complex one. It utilizes equalizing pulses which are added or separated from the TV signal when disturbances of gray scales are foreseen. In addition, since the fact that the false contour effect is motion relevant, different pulses for each possible speed are needed. That leads to the need of a big memory storing a number of big look-up tables (LUT) for each speed and there is a need of a motion estimator. Furthermore, since the false contour effect depends on the sub-field organization, the pulses have to be re-calculated for each new sub-field organization. However, the big disadvantage of this technique results from the fact that the equalizing pulses add failures to the picture to compensate for a failure appearing on the eye retina. Additionally, when the motion is increasing in the picture, there is a need to add more pulses to the picture and that leads to conflicts with the picture contents in case of very fast motion.

From the European Patent Application 98114883.6 of the applicant a different approach for reducing the false contour effect is known which will provide very good false contour reduction without any loss of vertical resolution. However, this algorithm which shiftes sub-fields in a direction determined by motion estimation is more complicated and there is a need to use a well adapted motion estimator. The implementation of this solution could take more time and needs more die-size in an IC.

In EP 0874349 (a patent application of THOMSON multimedia) another approach for reducing false contour effect called Bit Line Repeat technique is described. The idea behind this technique is to reduce, for some sub-fields named common sub-fields, the number of lines to be addressed by grouping two consecutive lines together. For the remaining sub-fields called normal sub-fields each line is addressed separately. Nevertheless this technique, causes a slight degradation of the vertical resolution dependent on the picture content and a new kind of noise could be perceived.

SUMMARY OF THE INVENTION

The invention aims to improve the bit line repeat technique in order to deliver better picture quality in terms of vertical resolution and noise. It is an object of the present invention to disclose a corresponding method and an apparatus for processing video pictures for display on a display device. This object is achieved by the measures claimed in claims 1 and 8.

While the bit line repeat algorithm is able to correctly encode lots of pixel value combinations of two or more consecutive lines, there are nevertheless some cases in which an error has to be made due to the reduced flexibility in encoding produced by the need to have the same code on common sub-fields. The general idea of the invention is now to put the coding failures on the higher video levels of the two or more pixels being grouped together (see claim 1). With this new method the reduction in vertical resolution and also the noise caused by the bit line repeat algorithm is shifted in a region where it is merely invisible for the viewer.

Advantageously, additional embodiments of the inventive method are disclosed in the respective dependent claims.

In the field of false contour effect compensation the addition of a dithering pattern to a picture brings some benefit. Especially it is positive for improving gray scale portrayal in a plasma picture. Often the value +1 is added to every other pixel in Quincunx form. To adapt the dithering method to bit line repeat technique, the invention proposes a somewhat different dithering pattern for use in combination with bit line repeat algorithm. Here, always the same value is added to the two or more pixels being grouped together in two or more consecutive lines. The resulting dithering pattern also has Quincunx form (see claim 2).

The bit line repeat method can be further improved by the general idea of making an analysis of the pictures in terms of picture content and switching ON or OFF the bit line repeat algorithm depending on the analysis result (see claim 3). E.g., when the picture content analysis reveals too much high vertical transitions in a number of pictures, the bit line repeat algorithm is switched off (see claim 4). This will improve the picture quality a lot in pictures which contain a lot of high vertical frequencies like pictures containing text or graphic with grids, etc. in which the eye will be more focused on these structures than on false contour effects. In fact it will reduce a lot the loss of vertical resolution in case of long critical scenes.

Further improvement is possible by using a motion detector for detecting motion in the picture. The basic idea is to switch off the bit line repeat algorithm when a frame does not contain enough motion (see claim 5). In case where a video sequence has only minor motion in it, no false contour effect will occur and the bit line repeat technique is not necessary.

These improvements can be refined by making a switching control dependent on the number of frames where motion has been detected or the picture content analysis has revealed that normal sub-field coding will bring better results (see claim 6).

The invention consists further in an apparatus for carrying out the inventive method. Advantageous embodiments for such an apparatus are given in claims 8 to 13.

BRIEF DESCRIPTION OF THE DRAWINGS

Exemplary embodiments of the invention are illustrated in the drawings and are explained in more detail in the following description.

In the figures.

DETAILED DESCRIPTION OF PREFERRED EMBODIMENTS

Figure 1:
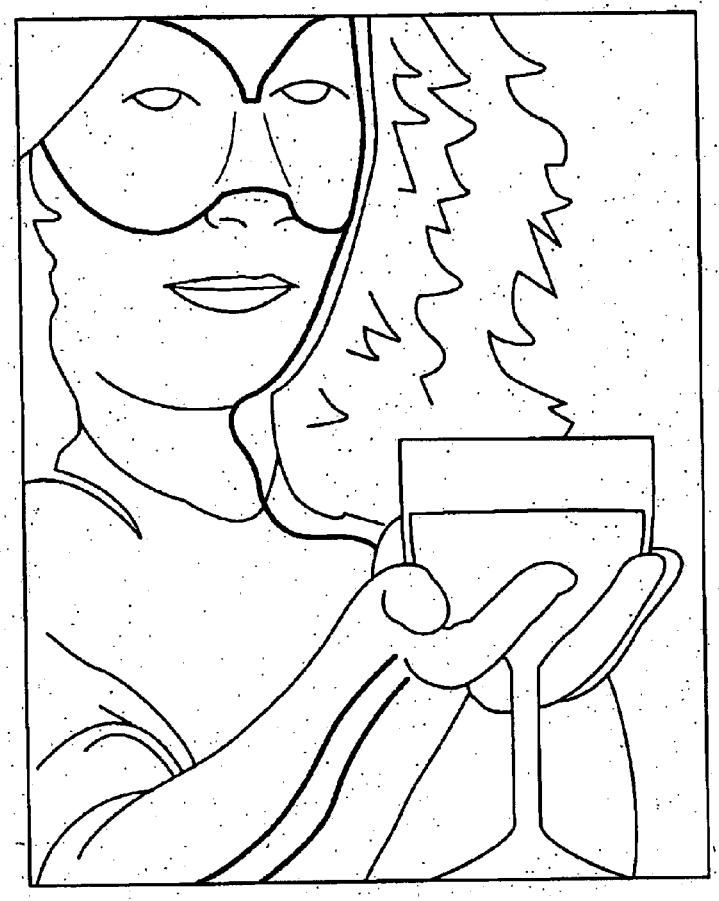
FIG. 1 shows a video picture in which the false contour effect is simulated.

The artefact due to the false contour effect is shown in FIG. 1. On the arm of the displayed woman are shown two dark lines, which e. g. are caused by this false contour effect. Also in the face of the woman such dark lines occur on the right side.

A plasma display panel utilizes a matrix array of discharge cells which could only be switched ON or OFF. Also unlike a CRT or LCD in which gray levels are expressed by analog control of the light emission, in a PDP the gray level is controlled by modulating the number of light pulses per frame. This time-modulation will be integrated by the eye over a period corresponding to the eye time response. When an observation point (eye focus area) on the PDP screen moves, the eye will follow this movement. Consequently, it will no more integrate the light from the same cell over a frame period (static integration) but it will integrate information coming from different cells located on the movement trajectory. Thus it will mix all the light pulses during this movement which leads to a faulty signal information. This effect will now be explained in more detail below.

Figure 2:
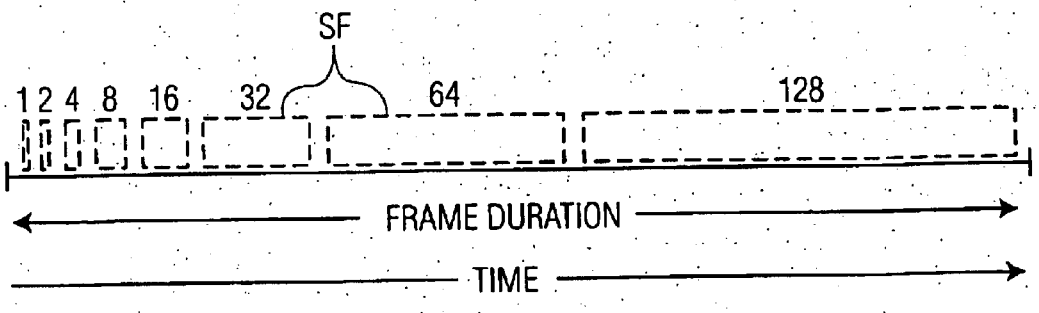
FIG. 2 shows an illustration for explaining the sub-field organization of a PDP.

In the field of video processing is an 8-bit representation of a luminance level very common. In this case each level will be represented by a combination of the following 8 bits: $2^0=1$, $2^1=2$, $2^2=4$, $2^3=8$, $2^4=16$, $2^5=32$, $2^6=64$, $2^7=128$ To realize such a coding scheme with the PDP technology, the frame period will be divided in 8 lighting periods which are also very often referred to sub-fields, each one corresponding to one of the 8 bits. To each bit a number of light pulses is assigned. E.g. the number of light pulses for the bit $2^1$ may be 22 which is the double of that for the bit $2^0=11$. With a combination of these 8 sub-periods, we are able to build said 256 different gray levels. Without motion, the eye of the observer will integrate over about a frame period these sub-periods and will have the impression of the right gray level. The above-mentioned sub-field organization is shown in FIG. 2. It is to be noted here, that the addressing periods (scan period) and the erasing periods are not shown in FIG. 2 for ease of understanding. These periods are required for each sub-field in plasma display technology which will be explained later on.

The light emission pattern according to the sub-field organization introduces new categories of image quality degradation corresponding to disturbances of gray levels and colors. As already explained, these disturbances are defined as so-called dynamic false contour effect since the fact that it corresponds to the appearance of colored edges in the picture when an observation point on the PDP screen moves. The observer has the impression of a strong contour appearing on a homogeneous area like displayed skin. The degradation is enhanced when the image has a smooth gradation and also when the light emission period exceeds several milliseconds. So, in dark scenes the effect is not so disturbing as in scenes with average gray level (e.g. luminance values from 32 to 223).

In addition, the same problem occurs in static images when observers are shaking the heads which leads to the conclusion that such a failure depends on the human visual perception.

Figure 3:
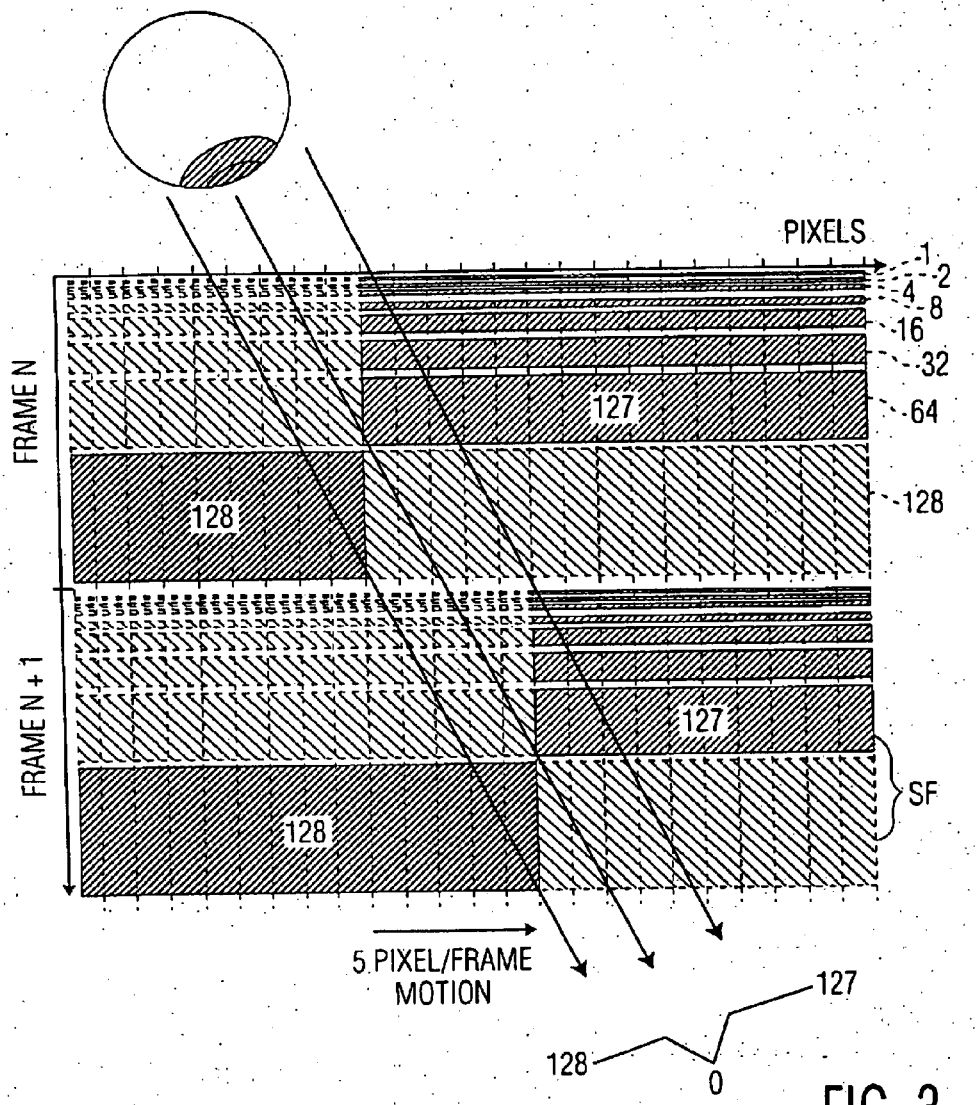
FIG. 3 shows an illustration for explaining the false contour effect.
Figure 4:
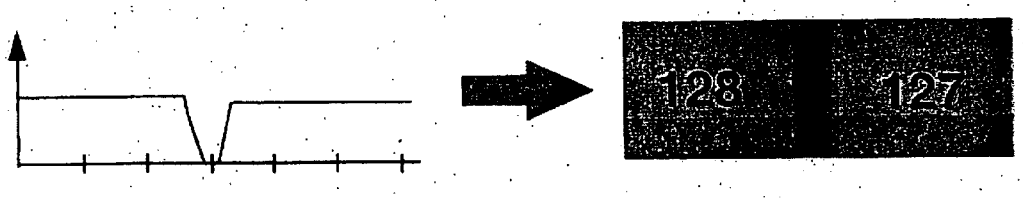
FIG. 4 illustrates the appearance of a dark edge when a display of frames is being made in the manner shown in FIG. 3.

To better understand a basic mechanism of visual perception of moving images, a simple case will be considered. Let us assume a transition between the luminance levels 128 and 127 moving at a speed of 5 pixel per video frame and the eye is following this movement. FIG. 3 shows a darker shaded area corresponding to the luminance level 128 and a lighter shaded area corresponding to the luminance area level 127. The sub-field organization, shown in FIG. 2 is used for building the luminance levels 128 and 127 as it is depicted on the right side of FIG. 3. The three parallel lines in FIG. 3 indicate the direction in which the eye is following the movement. The two outer lines show the area borders where a faulty signal will be perceived. Between them the eye will perceive a lack of luminance which leads to the appearance of a dark edge in the corresponding area which is illustrated in FIG. 4. The effect that a lack of luminance will be perceived in the shown area is due to the fact that the eye will no more integrate all lighting periods of one pixel when the eye focus area is in movement. Only part of the light pulses from one pixel will be integrated during the frame when the eye focus area moves since it jumps from one pixel to the next one during one frame. Therefore, there is a lack of corresponding luminance and the dark edge will occur. On the left side of FIG. 4, there is shown a curve which illustrates the behavior of the eye cells during observing the moving picture depicted in FIG. 3. The eye cells having a good distance from the horizontal transition will integrate enough light from the corresponding pixels. Only the eye cells which are near the transition will not be able to integrate a lot of light from the same pixels.

A way to reduce these artifacts is to decompose each luminance value on a bigger number of components (sub-fields) each one as small as possible in order to minimize the difference in the time axis of two neighborhood pixels. In that case the error made on the retina when the eye is 'moving' from one pixel to another could be lower and the false contour effect, too. Nevertheless an increasing of the sub-field number is limited according to the following relation:

$$n_{SF} \times NL \times T_{ad} + T_{Light} \leqq T_{Frame}$$

where $n_{SF}$ represents the number of Sub-Fields, NL the number of lines, $T_{ad}$ the duration to address one line per sub-field, $T_{Light}$ the lighting duration of the panel and $T_{Frame}$ the frame period. For the plasma display technology called ADS (address display separate) the addressing of plasma display panels, is usually made in lines, i.e. that all data for one line is written into the plasma display in one shot. The same relation is valid for another Plasma Display Technology called AWD (address while display) in which for different lines addressing, scanning and erasing are mixed together. Of course for each pixel only one sub-field code word bit is written into the plasma display during one shot. For each sub-field a separate addressing period is necessary. Obviously, an increasing of the sub-field number will reduce the time $T_{Light}$ to light the panel and consequently, will reduce the global contrast of the panel due to more required addressing and erasing periods.

Figure 5:
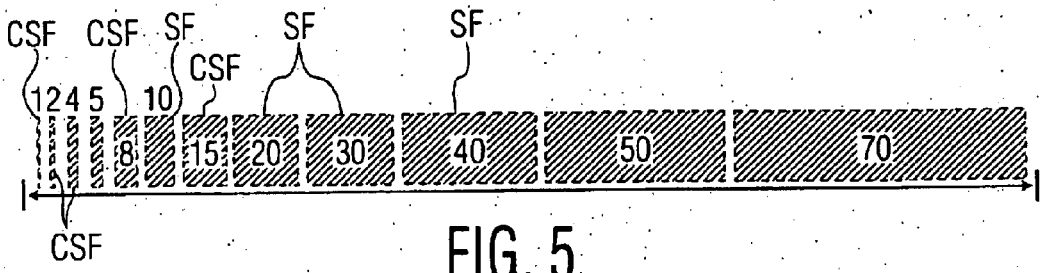
FIG. 5 shows a refined sub-field organization.

A new sub-field organization which has more sub-fields is shown in FIG. 5. In this example there are twelve sub-fields and the weights of the sub-fields are given in the figure.

Figure 6:
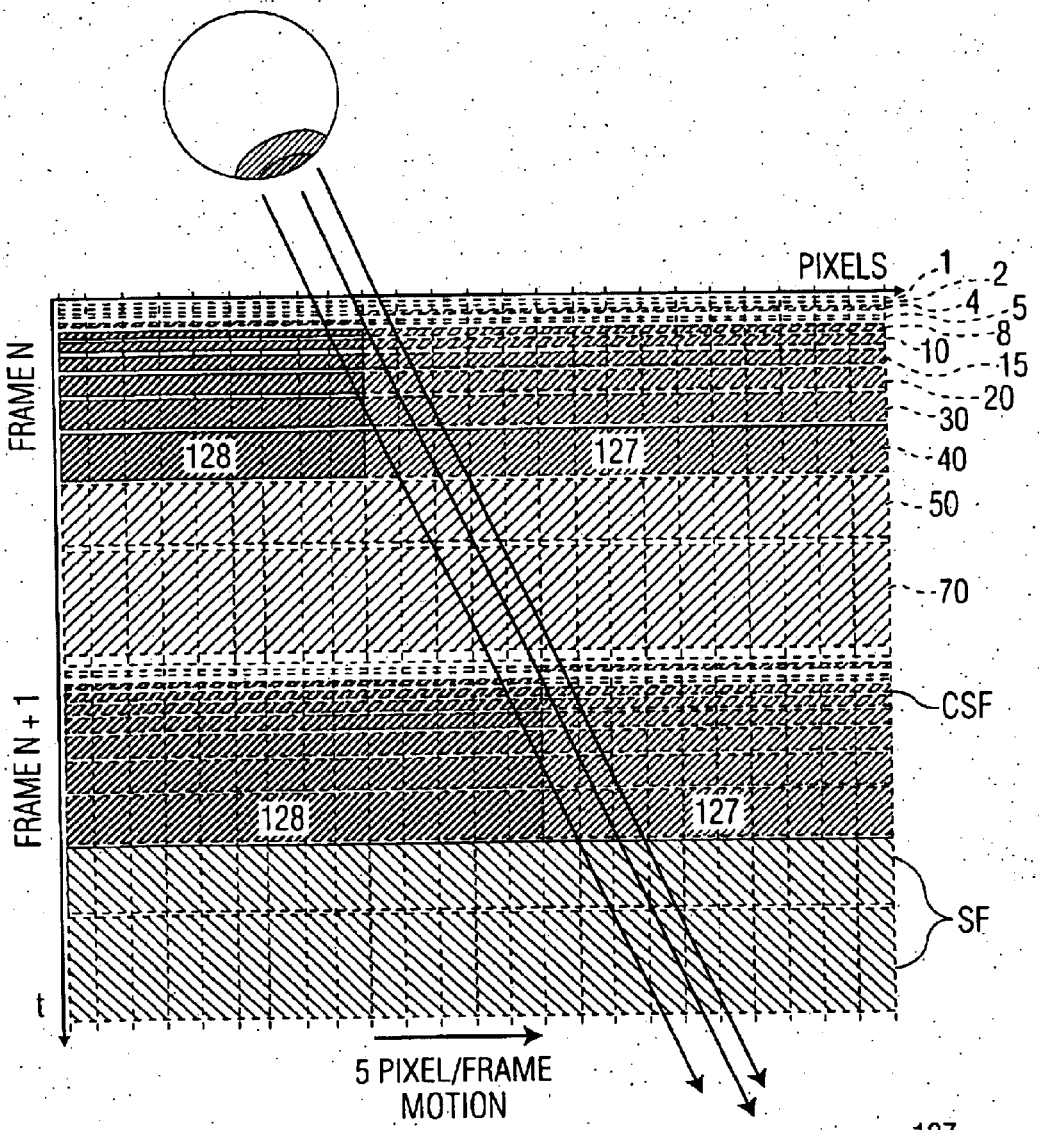
FIG. 6 shows the illustration of FIG. 3 but with sub-field organization according to FIG. 5.

In FIG. 6 the result of the new sub-field organization according to the example of FIG. 5 is shown in case of the 128/127 horizontal transition moving at a speed of five pixels per frame. Now, the chance that the corresponding eye cells will integrate more similar amounts of lighting periods is increased. This is illustrated by the eye-stimuli integration curve at the bottom of FIG. 6 when compared to the eye-stimuli integration curve at the bottom of FIG. 3. The strongest failure occurring on the retina is reduced a lot from 0 to 123.

Consequently, the first idea one can have is to increase a lot the number of Sub-Fields and then the picture quality in case of motion will be improved, too. Nevertheless an increasing of the sub-field number is limited according to the above given relation:

$$n_{SF} \times NL \times T_{ad} + T_{Light} \leqq T_{Frame}$$

obviously, an increasing of the sub-field number will reduce the time $T_{Light}$ to light the panel and consequently, will reduce the global brightness and contrast of the panel.

In another patent application of Thomson multimedia, see EP 0874349 the idea has been described to reduce for some sub-fields called common sub-Fields, the number of lines to be addressed by grouping two consecutive lines together. In that case the previous relation is modified to the following one:

$$n_{CommonSF} \times \frac{NL}{2} \times T_{ad} + n_{NormalSF} \times NL \times T_{ad} + T_{Light} \leq T_{Frame}$$

where $n_{CommonSF}$ represents the number of common Sub-Fields, $n_{NormalSF}$ represents the number of the other Sub-Fields ,NL the number of lines, $T_{ad}$ the duration to address one sub-field per line, $T_{Light}$ the lighting duration of the panel and $T_{Frame}$ the frame period. For the disclosure of the invention explained in this patent application, it is also referred to EP 0874349 accordingly.

The bit line repeat technique allows for the application of a refined sub-field organisation like the on e shown in FIG. 5. On the other hand with the bit line repeat technique, a slight degradation of the vertical resolution and a new kind of noise could be perceived. This will be apparent from the full explanation of the bit line repeat technique given below.

For this explanation it is assumed that for a given plasma display panel it is possible to address only 9 sub-fields under the constraint to have acceptable contrast ratio. On the other hand with 9 sub-fields, the false contour effect will stay very disturbing. Therefore, bit line repeat mode is used for improving the situation. The aim is to have a sub-field organisation like the one shown in FIG. 5, which has quite a good behaviour concerning the false contour issue. This is achieved in a coding scheme with 6 independent sub-fields SF and 6 common sub-fields CSF. Then the previous relation becomes:

$$6 \times \frac{NL}{2} \times T_{ad} + 6 \times NL \times T_{ad} + T_{Light} = 9 \times NL \times T_{ad} + T_{Light} \leq T_{Frame}$$

which is equivalent to the relation in case of a 9 sub-field coding scheme. Consequently, with such a bit-line repeat coding, we will artificially dispose of 12 Sub-Fields with the same light period as with 9 Sub-Fields (same brightness and contrast).

A representation of this example of bit-line repeat coding is as following:

<u>1</u>–<u>2</u>–<u>4</u>–5–<u>8</u>–10–<u>15</u>–20–<u>30</u>–40–50–70 in which the underlined values represent the common sub-field values.

It is to be noted that at the places of these common sub-fields CSF the sub-field code words will be the same for the corresponding pixels of two consecutive lines.

Figures 7, 8:
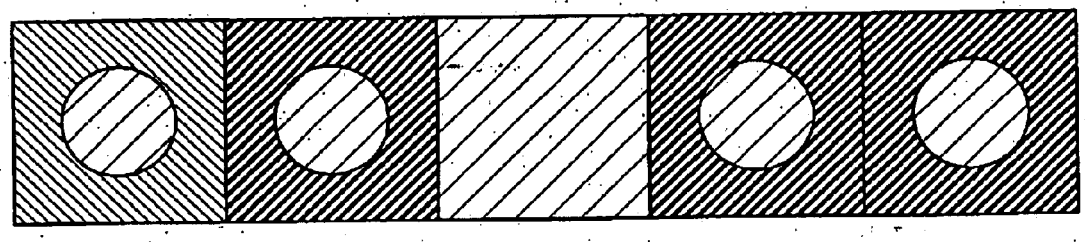
FIG. 7 illustrates the grouping of two consecutive pixel lines for addressing purpose according to the bit line repeat method.
FIG. 8 shows an illustration for explanation of the human visual system sensitivity.

An example is given in FIG. 7. In this figure the pixel values 36 and 51 located at the same horizontal position on two consecutive pixel lines are shown.

There are different possibilities to encode these values. These possibilities are listed below where in brackets the corresponding sub-field codes for the 6 common sub-fields CSF are given starting with the most significant bit of the common sub-field codes:

| | |
|---|---|
| 36 = 30 + 4 + 2 (100110) | 51 = 50 + 1 (000001) |
| = 30 + 5 + 1 (100001) | = 40 + 10 + 1 (000001) |
| = 20 + 15 + 1 (010001) | = 40 + 8 + 2 + 1 (001011) |
| = 20 + 10 + 5 + 1 (000001) | = 40 + 5 + 4 + 2 (000110) |
| = 20 + 10 + 4 + 2 (000110) | = 30 + 20 + 1 (100001) |
| = 20 + 8 + 5 + 2 + 1 (001011) | = 30 + 10 + 8 + 2 + 1 (101011) |
| = 15 + 10 + 8 + 2 + 1 (011011) | = 30 + 10 + 5 + 4 + 2 (100110) |
| = 15 + 10 + 5 + 4 + 2 (010110) | = 20 + 15 + 10 + 5 + 1 (010001) |
| | = 20 + 15 + 10 + 4 + 2 (010110) |
| | = 20 + 15 + 8 + 5 + 2 + 1 (011011) |

For this example it is easy to encode these two values without any error (no loss of vertical resolution) in case of bit-line repeat sub-field coding. It is only necessary to find the sub-field code words having the same coding on the common sub-fields (see the same values in brackets). The equivalent sub-field code word pairs are listed below:

| | | |
|---|---|---|
| 36 = 30 + 4 + 2 | and | 51 = 30 + 10 + 5 + 4 + 2 |
| 36 = 30 + 5 + 1 | and | 51 = 30 + 20 + 1 |
| 36 = 20 + 15 + 1 | and | 51 = 20 + 15 + 10 + 5 + 1 |
| 36 = 20 + 10 + 5 + 1 | and | 51 = 50 + 1 |
| 36 = 20 + 10 + 5 + 1 | and | 51 = 40 + 10 + 1 |
| 36 = 20 + 10 + 4 + 2 | and | 51 = 40 + 5 + 4 + 2 |
| 36 = 20 + 8 + 5 + 2 + 1 | and | 51 = 40 + 8 + 2 + 1 |
| 36 = 15 + 10 + 8 + 2 + 1 | and | 51 = 20 + 15 + 8 + 5 + 2 + 1 |
| 36 = 15 + 10 + 5 + 4 + 2 | and | 51 = 20 + 15 + 10 + 4 + 2 |

Nevertheless, there are some cases in which an error has to be made due to the reduced flexibility in encoding produced by the need to have the same coding for each common sub-field CSF. For instance, if the pixel values 36 and 52 represent a pixel pair, then its necessary to replace them with 36 and 51 or 37 and 52 to have the same code on common sub-fields. This lack of flexibility introduces a noise, which may be called BLR-noise (bit line repeat noise).

In addition, since there is the constraint to have common values for corresponding pixels on two consecutive lines, the biggest difference between corresponding pixels of the two lines can only be achieved with the normal sub-fields SF. That means, for above given example, that the maximum vertical transition in the picture is limited to 195. This new limitation introduces obviously a reduction of the vertical resolution.

The basic idea of this invention is now to modify the bit line repeat method in order to let such effects, BLR-noise and reduced vertical resolution, being invisible for the viewer.

In the following the human visual system (HVS) is now explained in greater detail because it will be utilised for the invention.

The human visual system (HVS) is not directly sensible to the luminance of observed objects but more to the variation of luminance inside the observed area, that means the local contrasts. This phenomenon is illustrated in FIG. 8.

In the middle of each area, the gray disk has the same gray level, but our eye does not perceive it in the same way in each case (the perceived luminance of each disk depends on the background luminance).

This phenomenon studied a long time ago, is well known in optics and is called 'Weber-Fechner' law. In fact, the scientists have taken a disk of luminance I+ΔI in front of a homogeneous background with luminance I, and have-searched for the limit of the ratio ΔI/I (Weber ratio) which could be perceived for different luminance values. The result was that this ratio is constant for most of the luminance domain. That leads to the conclusion that according to the mathematical formula $$\frac{\Delta I}{I} \approx d(\log I) = \Delta c = (\text{constant})$$

the human eye will have a logarithm behavior under the form $$I_{eye}=a_1+a_2\cdot\log_{10}(I_{Plasma})$$

where $a_1$ and $a_2$ are constants and $I_{Plasma}$ is the luminance of the plasma display and $I_{Eye}$ is the reduced luminance which will be perceived.

This behaviour of the eye is utilised for the invention in that, each error made on a low video level will have a stronger impact on the human visual system than the same error made on a higher video level. Consequently, the idea of the invention is to make the errors in sub-field coding if unavoidable on the higher video level of a pixel pair. This can be done very easily by comparing the two pixel values.

With the exemplary values 36 and 52 the new method is explained. In order to encode this values with the bit-line repeat algorithm, it is unavoidable to make an error of 1, that means it is necessary to replace 36 by 37 or 52 by 51. Nevertheless, for the human visual system, an error of 1 for a 36 value is stronger than an error of 1 for a 52 value. Consequently, with the new method it will be replaced 36/52 by 36/51 and this pixel pair will be encoded as given in the example above. As there is more than one possibility for the sub-field encoding of these values, it is necessary to make a selection. One possible rule being useful for this selection is e.g. to select the code word where the luminance is widely spread over the frame period. This means that the one with the most number of sub-fields will be used. For the above given example the code words: 36=15+10+8+2+1 and 51=20+15+8+5+2+1
will be used. Of course a table can be used in the algorithm having entered the different sub-field code words for a given pixel value and the entries are compared for the pixel values of a pixel pair. From the corresponding sub-field code word pairs the best one is selected according to above explained rule.

With this modified bit line repeat method the the BLR-noise can be reduced a lot.

The same principle will be used for the reduction of the visibility of the vertical resolution loss. Also an example is presented here. For example there is a vertical transition between the pixel values 16 and 248. As noted above, vertical transitions are limited by the value 195 in our example. Consequently, in order to encode the transition 16/248 (Δ=232) it is necessary to make an error of 232−195=37. This error will be put on the high video level 248 only to reduce its visibility for the eye and so the transition 16/248 is coded as following:

16=15+1 and 248≈211=70+50+40+20+15+10+5+1

This principle will make the BLR-noise and a kind of vertical resolution loss less visible for the human eye.

Some pictures will of course contain a lot of high vertical frequencies like in pictures displaying text, or graphic with small grids, etc. in which the eye will be more focused on these structures than on false contour effects. In addition, the false contour effect will occur mainly on big homogeneous areas which implicate a lowest quantity of high vertical frequencies.

It is therefore another principle of the invention to count, for each frame, the amount of vertical transitions which exceed the valid BLR_Limit (which is 195 in the exemplary embodiment explained above). Vertical transition means here the pixel pairs in two consecutive lines having pixel value differences greater than BLR_Limit. These pixel pairs are counted in a counter BLR_VFT _Count which stands for vertical transition per frame counter. This counter will be reset at the end of each frame.

Figure 9:
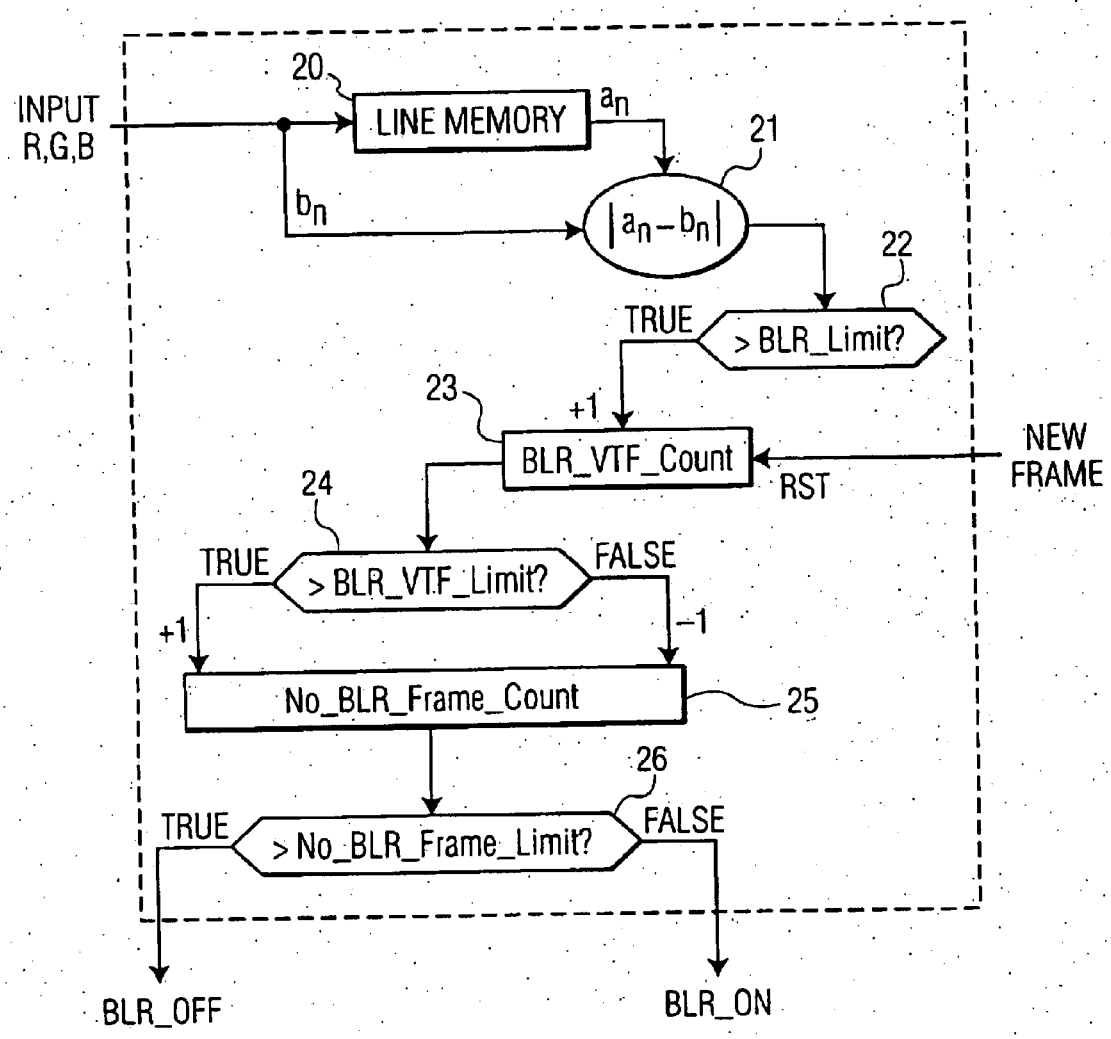
FIG. 9 shows a flow chart for illustrating the algorithm which activates and deactivates the bit line repeat mode dependent on an analysis of the picture content.

The principle is illustrated in FIG. 9. The algorithm has as an input R,G,B data. It is therefore necessary to make the analysis three times, i.e. for every component of R,G,B data. The data input for one line is fed to a line memory 20 and in parallel to a calculation unit 21 where absolute differences between corresponding pixels $a_n$, $b_n$ of two consecutive lines are calculated. The result is fed to a comparing unit 22 where it is compared to the BLR_Limit. In case the result exceeds the BLR_limit, a so called BLR_VFT _Counter 23 is incremented. VTF stands for vertical transitions per frame. This counter is reset after a full frame has been processed. The stage of the BLR_VTF_Counter 23 is monitored in another comparing unit 24. When the BLR_VTF_Counter 23 exceeds a BLR_VFT _Limit value at the end of a frame, another counter called No_BLR_Frame_Counter 25 is incremented. This counter represents the amount of consecutive frames having too much high vertical frequencies. In case the count result of the BLR_VTF_Counter 23 is equal or smaller than BLR_VTF_Limit at the end of a frame, the No_BLR_Frame_Counter 25 is decremented.

Also the counting stage of the No_BLR_Frame_Counter 25 is monitored in another comparing unit 26. The bit line repeat algorithm will be activated as long as the No_BLR_Frame_Counter 25 stays below a limit value No_BLR_Frame_Limit. When more critical frames than the limit value have been detected, the bit line repeat algorithm is switched off and the normal sub-field coding algorithm is started. This means that sub-field coding with 9 sub-fields is used, see explanation above. Of course an hysteresis like switching behaviour can be implemented in order to avoid fast oscillation between bit line repeat mode and non bit line repeat mode.

So, the basic idea of this improvement is to detect critical frames, containing too much vertical transitions/frequencies where bit line repeat mode is unable to encode correctly, and then to check how many frames are critical. After a certain time of critical frames the bit line repeat mode is switched off and after a certain time of uncritical scenes the bit line repeat mode is switched ON again.

Yet, a video sequence could have only few high vertical frequencies and also relatively low motion in it. In that case no false contour effect will happen and the bit line repeat technique is not necessarily required. This allows for an optional improvement of the algorithm based on a motion detector (not estimator).

The improvement consists in the provision of a simple motion detector in the algorithm. The basic idea is to switch off the bit line repeat algorithm when a lot of frames do not contain enough motion.

In the prior art there are a lot of motion detectors available which can be used here. For instance, some algorithm based on the study of the entropy of the picture or some histogram analysis are able to provide the information of 'how much motion' the picture contains and that will be enough to switch OFF or ON the bit line repeat algorithm. There are simple pixel based motion detectors available where the pixels of two succeeding frames are compared. For example a motion detector which can be used here is described in the European Patent Application EP 98400918.3 of Thomson multimedia. In this patent application a method for detecting static areas in a video picture is disclosed. This method could be modified in that way that in cases where a lot of static areas have been detected in the picture the bit line repeat mode is switched off.

Figure 10:
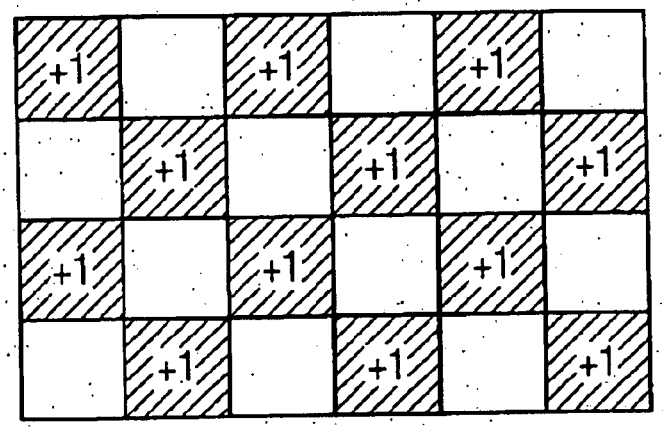
FIG. 10 shows an example of a conventional dithering pattern used in plasma display panels for gray scale portrayal improvement.

In plasma display technology sometimes the dithering method is used for further improving picture quality. This technique is primarily used to improve the gray scale portrayal in a plasma picture. The basic idea behind this method is to add a small 'noise' in the picture like the one shown in FIG. 10. There, to every other pixel on a line the value +1 is added and the remaining pixels remain unchanged. The pattern shown in FIG. 10 is often called Quincunx pattern. Of course the pattern will be changed from frame to frame, i.e. that on the next picture the complementary pattern is used where the pixels to which the value +1 is added and the ones which remain unchanged are exchanged. Such a pattern will be invisible for an observer located at a normal TV viewing distance but will improve a lot the gray scale fidelity.

In addition it is known that the dithering method will lead also to an improvement in the false contour issue since it will hide this effect through the adding of an 'invisible' noise.

Another embodiment of the invention deals therefore, with the adaptation of the dithering method for use in combination with the bit line repeat technique.

Figure 11:
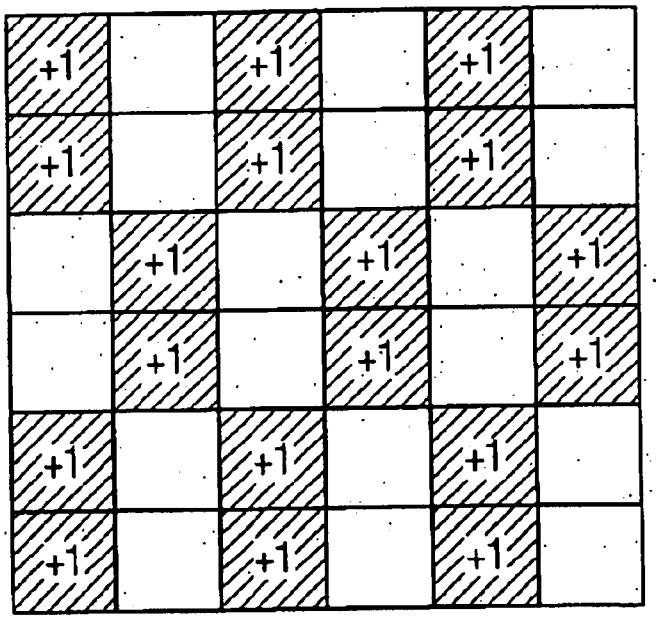
FIG. 11 shows an example of an adapted dithering pattern for bit line repeat mode and FIG. 12 shows a block diagram of the apparatus according to the invention.

The invention solves this problem by using a modified dithering pattern which has an adapted form, depicted in FIG. 11. In this modified dithering pattern the value +1 is added to every other pixel pair of two consecutive lines. Of course, this pattern is changed from frame to frame in the same sense as described above.

This adapted dithering method is fully compatible with the bit line repeat technique and will further improve the plasma picture quality.

Figure 12:
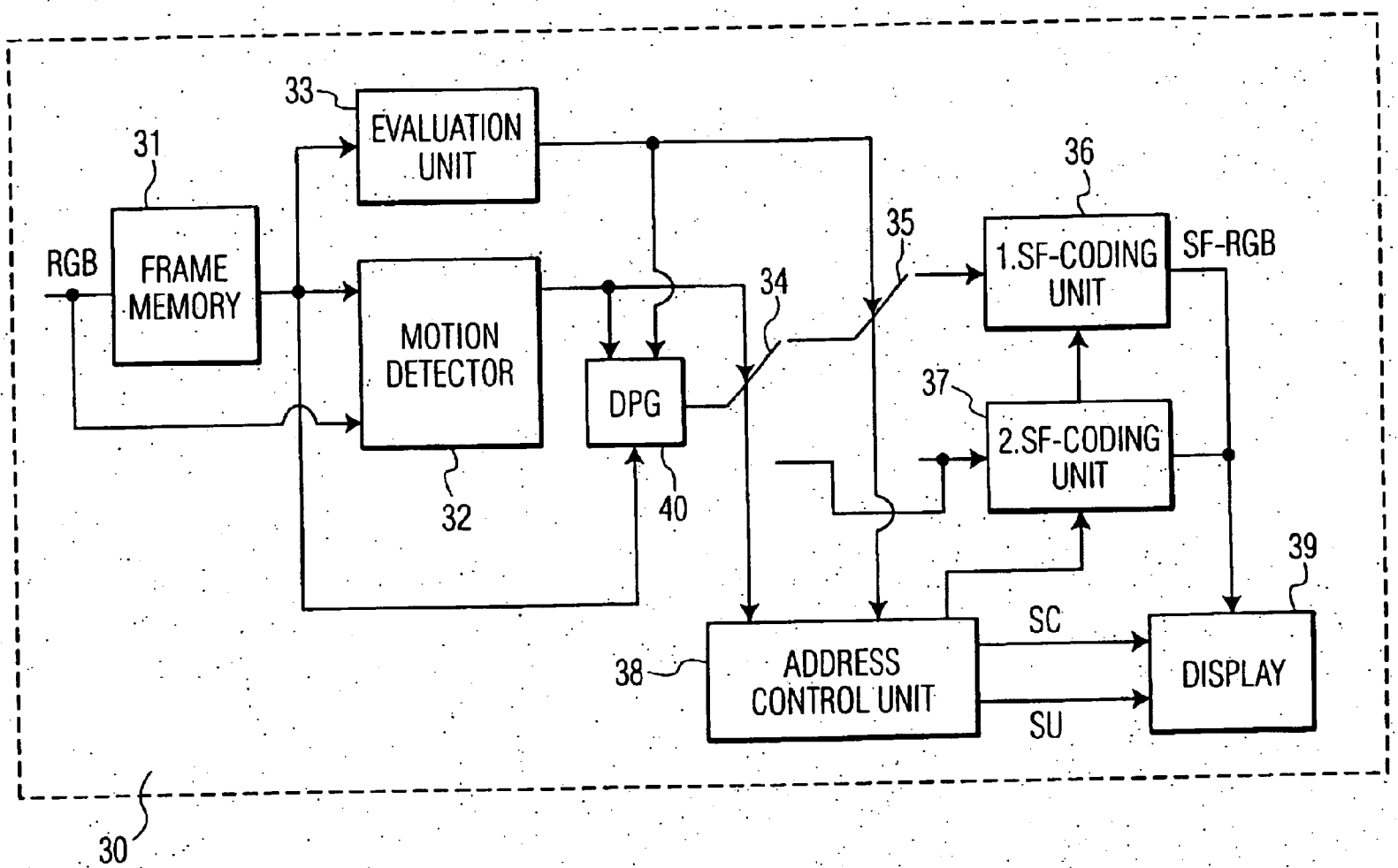

An apparatus according to the invention is shown in FIG. 12. The apparatus may be integrated together with the PDP matrix display. It could also be in a separate box which is to be connected with the plasma display panel. Reference no. 30 denotes the whole apparatus. Reference no. 31 denotes the frame memory to which the RGB data is input. The frame memory 31 is connected to an optional motion detector 32 and to an optional evaluation unit 33 where the algorithm for detecting the critical images having included a high number of vertical transitions is carried out. The motion detector 32 receives additionally RGB data of the current frame. So, it has access to the RGB data of the previous and the current frame which is necessary for motion detection. Motion detector 32 and evaluation unit 33 generate switching signals for corresponding switches 34 and 35. With this switches the bit line repeat mode is switched on or switched off according to the algorithms describe above. When both switches 34 and 35 are switched in the BLR on state, a first sub-field coding unit 36 is activated and a second sub-field coding unit is deactivated. The first unit 36 will then be supplied with the RGB data stored in frame memory 31. The bit line repeat sub-field coding is done in this unit with the algorithm described above inclusive the improvement that the coding error is shifted to the higher pixel values of the pixel pairs.

The switching signals from evaluation unit 33 and motion detector 32 are also fed to a dithering pattern generator 40 which generates the adapted dithering patterns for the corresponding sub-field coding modes as explained above.

In case one or both switches are switched in the BLR off state, the sub-field coding unit 36 is deactivated and the second sub-field coding unit 37 is activated. The second sub-field coding unit 37 is activated and it will be supplied with the RGB data stored in frame memory 31. In this unit sub-field coding is done with the normal sub-field organisation including 9 sub-fields. The generated sub-field code words for the pixels are output to the display 39 under the control of an address control unit 38. This unit receives also the switching control signals from units 32 and 33. It generates then the scan pulses sc for addressing the pixel lines and the sustain pulses su for lighting the plasma cells. It is noted that less scan pulses have to be generated for the common sub-fields when bit line repeat mode is switched on due to the fact that two consecutive lines are addressed in parallel for the common sub-fields.

It goes without saying that some blocks shown in FIG. 9 and 12 can be implemented with appropriate computer programs for the same function instead.

The invention is not restricted to the disclosed embodiments. Various modifications are possible and are considered to fall within the scope of the claims. E.g. a different sub-field organisations could be used for bit line repeat mode and normal mode. More than two lines could be combined for bit line repeat mode. Another dithering pattern could be used which also fulfills the rule that to all pixels of one pixel pair or n-tupel, identical values are added respectively are unchanged.

The different improvements for bit line repeat technique could also be used singly rather than in combination with the first mentioned improvement regarding shifting of the coding error to the higher pixel values.

All kinds of displays which are controlled by using different numbers of pulses for gray-level control can be used in connection with this invention.

What is claimed is:

1. Method for processing video pictures for display on a display device (39) having a plurality of luminous elements corresponding to the pixels of a picture, wherein the time duration for a video frame or video field is divided into a plurality of sub-fields (SF) during which the luminous elements can be activated for a light emission in small pulses corresponding to a sub-field code word which is used for brightness control, wherein for corresponding pixels of two or more pixel lines sub-field code words are determined which have identical entries for a number of sub-fields called common sub-fields (CSF), characterized in that, in cases where with the common (CSF) and remaining normal sub-fields (SF) no exact luminance representation of a given pixel value can be achieved, the unavoidable coding error is systematically shifted to the pixel or pixels with the highest pixel value.

2. Method according to claim 1, wherein a dithering pattering is added to the picture before coding and the dithering pattern fulfills the rule that always the same value is added to the corresponding two or more pixels being grouped together in said two or more consecutive lines.

3. Method according to claim 1, wherein an analysis of the pictures in terms of picture content is made and sub-field coding with common (CSF) and normal sub-fields (SF) is stopped when the picture content analysis reveals that the content of the picture is uncritical regarding disturbances caused by normal sub-field coding only and sub-field coding with normal sub-fields only is started.

4. Method according to claim 3, wherein the picture content analysis includes a step of counting strong vertical transitions between two corresponding pixels of two consecutive lines and when the number of strong vertical transitions in a picture exceeds a predetermined limit, the picture is classified as being uncritical regarding normal sub-field coding disturbances.

5. Method according to claim 3, wherein a step of detecting motion in a picture is further included and when the motion in a picture is lower than a predetermined value the picture is classified as being uncritical regarding normal sub-field coding disturbances.

6. Method according to claim 3, wherein switching from sub-field coding with common (CSF) and normal sub-fields (SF) to sub-field coding with normal sub-fields (SF) only is done only after a predetermined number of pictures has been classified as being uncritical regarding normal sub-field coding disturbances.

7. Method according to claim 3, wherein a switch back operation is done from sub-field coding with normal sub-fields (SF) only to sub-field coding with common (CSF) and normal sub-fields (SF) only after a predetermined number of pictures have been classified as being critical regarding normal sub-field coding disturbances.

8. Apparatus for carrying out the method according to claim 1, the apparatus having a frame memory (31) for storing pixel data, characterized in that the apparatus comprises a first sub-field coding unit (37) which makes a subfield coding based on normal sub-fields (SF) only for each pixel separately and a second sub-field coding unit (36) which makes a sub-field coding based on common (CSF) and normal sub-fields (SF) in a combined manner for two or more corresponding pixels of two or more consecutive lines.

9. Apparatus according to claim 8, wherein the second sub-field coding unit (36) includes means for shifting unavoidable coding errors caused under the constraint of the combined sub-field coding, to the pixel or pixels with the highest pixel value.

10. Apparatus according to claim 8, further including a motion detector (32) for detecting motion in pictures and for generating a switching signal which stopps sub-field coding based on common (CSF) and normal sub-fields (SF) and starts sub-field coding based on normal sub-fields (SF) only when the detected motion is below a predetermined level.

11. Apparatus according to claim 8, further including a picture content analysis until (33) in which strong vertical transitions between two corresponding pixels of two consecutive lines are counted and for generating a switching signal which stopps sub-field coding based on common (CSF) and normal sub-fields (SF) and starts sub-field coding based on normal sub-fields (SF) only when the number of strong vertical transitions in a picture exceeds a predetermined limit.

12. Apparatus according to claim 8, further including a dithering pattern generator (40) which adds adapted different dithering patterns to a picture dependent on the sub-field coding mode which is activated.

13. Apparatus according to claim 8, the apparatus comprising a matrix display, especially plasma display.

14. Method for processing video pictures for display on a display device having a plurality of luminous elements corresponding to the pixels of a picture, wherein the time duration for a video frame or video field is divided into a plurality of sub-fields (SF) during which the luminous elements can be activated for a light emission in small pulses corresponding to a sub-field code word which is used for brightness control, wherein for corresponding pixels of two or more pixel lines sub-field code words are determined which have identical entries for a number of sub-fields called common sub-fields (CSF), wherein, in cases where with the common (CSF) and remaining normal sub-fields (SF) no exact luminance representation of a given pixel value can be achieved, the unavoidable coding error is shifted to the pixel or pixels with the highest pixel value, and wherein a dithering pattering is added to the picture before coding and the dithering pattern fulfills the rule that always the same value is added to the corresponding two or more pixels being grouped together in said two or more consecutive lines.

15. Method for processing video pictures for display on a display device having a plurality of luminous elements corresponding to the pixels of a picture, wherein the time duration for a video frame or video field is divided into a plurality of sub-fields (SF) during which the luminous elements can be activated for a light emission in small pulses corresponding to a sub-field code word which is used for brightness control, wherein for corresponding pixels of two or more pixel lines sub-field code words are determined which have identical entries for a number of sub-fields called common sub-fields (CSF), wherein, in cases where with the common (CSF) and remaining normal sub-fields (SF) no exact luminance representation of a given pixel value can be achieved, the unavoidable coding error is shifted to the pixel or pixels with the highest pixel value, and wherein an analysis of the pictures in terms of picture content is made and sub-field coding with common and normal sub-fields is stopped when the picture content analysis reveals that the content of the picture is uncritical regarding disturbances caused by normal sub-field coding only and sub-field coding with normal sub-fields only is started.

* * * * *